US007117559B1

(12) United States Patent
Barber

(10) Patent No.: US 7,117,559 B1
(45) Date of Patent: Oct. 10, 2006

(54) SUPPORT SYSTEM FOR POCKET DOORS

(76) Inventor: David Barber, 5475 S. Camargo Rd., Littleton, CO (US) 80123

( * ) Notice: Subject to any disclaimer, the term of this patent is extended or adjusted under 35 U.S.C. 154(b) by 86 days.

(21) Appl. No.: 10/918,133

(22) Filed: Aug. 14, 2004

(51) Int. Cl.
*A47H 15/00* (2006.01)
*E05D 15/16* (2006.01)

(52) U.S. Cl. ..... 16/97; 16/105

(58) Field of Classification Search ..... 16/97, 16/91, 98, 102, 106, 107; 49/127, 404, 409; 160/188, 199, 196.1, 201
See application file for complete search history.

(56) References Cited

U.S. PATENT DOCUMENTS

| | | | | | |
|---|---|---|---|---|---|
| 2,207,322 | A | * | 7/1940 | Long | 49/409 |
| 2,230,615 | A | * | 2/1941 | Otto | 16/97 |
| 2,525,143 | A | * | 10/1950 | Martin | 16/89 |
| 2,670,496 | A | * | 3/1954 | Knight | 16/97 |
| 2,761,172 | A | * | 9/1956 | Jorgensen et al. | 16/105 |
| 2,791,005 | A | * | 5/1957 | Thompson | 49/409 |
| 2,957,197 | A | * | 10/1960 | Johnson, Jr. | 16/105 |
| 3,022,537 | A | * | 2/1962 | Blackmer | 16/105 |
| 3,057,005 | A | * | 10/1962 | Dishaw | 16/105 |
| 3,118,170 | A | * | 1/1964 | Zollinger | 16/105 |
| 3,193,871 | A | * | 7/1965 | Foltz | 210/98 |
| 3,479,682 | A | * | 11/1969 | McNinch | 16/97 |
| 3,757,384 | A | | 9/1973 | Rusch | |
| 3,813,728 | A | | 6/1974 | Johnson | |
| 3,829,929 | A | * | 8/1974 | Foltz et al. | 16/97 |
| 4,059,091 | A | * | 11/1977 | Cobb | 126/545 |
| 4,945,605 | A | | 8/1990 | Haab et al. | |
| 5,035,025 | A | | 7/1991 | Morris et al. | |
| 6,209,171 | B1 | | 4/2001 | Pelletier et al. | |
| 6,463,625 | B1 | | 10/2002 | Mittag | |
| 2004/0016080 | A1 | | 1/2004 | De Oliveira | |

FOREIGN PATENT DOCUMENTS

| | | | | |
|---|---|---|---|---|
| EP | 502285 | A1 | * | 9/1992 |
| EP | 1469151 | A1 | * | 10/2004 |
| JP | 11241560 | A | * | 9/1999 |

* cited by examiner

*Primary Examiner*—Chuck Y. Mah
(74) *Attorney, Agent, or Firm*—Ramon L. Pizarro; Edwin Crabtree

(57) ABSTRACT

A support system for mounting a door, such as a pocket door, on an overhead track is disclosed. The system cooperates with carriage that includes a support rod having a discontinuity at a lower end. The system uses bracket that is adapted for mounting along the upper edge of the door, and an engagement bar that is adapted for engaging the discontinuity on the support rod, so that the door is suspended from the track through the carriage by inserting the discontinuity through the bracket and engaging the discontinuity with the engagement bar, trapping the lower end of the support rod through the aperture in the bracket.

12 Claims, 3 Drawing Sheets

SUPPORT SYSTEM FOR POCKET DOORS

BACKGROUND OF THE INVENTION (a) Field of the Invention

This invention generally relates to a system for mounting pocket doors. More particularly, but not by way of limitation, to a system that allows quick mounting and removal of a pocket door from its tracks without requiring the removal of trim pieces around the pocket door assembly.

(b) Discussion of Known Art

Pocket doors, that is doors that supported from a horizontal overhead rail that allows concealment of the door into an adjacent wall, have been used for over a century. The space saving advantages of these doors have long been understood, but their popularity has fallen short of expectations. One significant reason for the underutilization of these doors is that the doors are difficult to replace when damaged. The source of these difficulties is that the most of the mechanism for supporting the door is concealed within a wall. Frequently, removing the door for repair or replacement requires destruction of the wall and associated trim, and thus the cost of repairing a damaged door or mechanism often exceeds the value of the whole assemby.

An example of a known device for mounting a moveable door, such as a pocket door, is found in U.S. Pat. No. 6,209,171 to Pelletier et al. The Pelletier et al. device uses a bracket that accepts a locking member or stud that cooperates with a pivoting release lever that engages the locking member, trapping it against the bracket. An important aspect of this type of device is that it may be used to mount pocket doors or other doors that are mounted along an overhead track. A significant disadvantage of the system disclosed by Pelletier et al., as well as other known systems, is that release or removal of the door from the supports requires access to each of the locking members. In the case of a pocket door this access is available only in the situation where the wheels, carriage, or portion of the door that fails is exposed, which if properly trimmed is typically not the case.

A typical failure of mechanisms that support pocket doors is the failure of the bearings or wheels that are used to support the door from the overhead track. Failure of these bearings or wheels can make the door difficult if not impossible to move along the overhead track without damaging the door or other components of the system. Thus, if a component fails while the door is inserted into the "pocket" within the wall, it may be impossible to pull the door back out without damaging other components of the system or the wall around the door.

Therefore, a review of known devices reveals that there remains a need for a simple device that supports a pocket door, and allows removal and installation of the entire door from outside the "pocket" or recess that houses the door, without removing the trim that surrounds the door.

There remains a need for a system that allows the removal and installation of the pocket door without having to remove the surrounding trim or wall structure.

There remains a need for a cost effective easily serviceable system for supporting a movable door along an overhead track.

There remains a need for a pocket door support system that can be easily modified in the field and that allows easy installation and removal of the pocket door from the tracks that support the door.

SUMMARY

It has been discovered that the problems left unanswered by known art can be solved by providing a support system for mounting a door on an overhead track, the door having an upper edge, and is attached through the upper edge to a carriage that rides on the track, the system includes:

a bracket that is adapted for mounting along the upper edge of the door, the bracket including an bridging portion that includes an aperture therethrough;

a carriage, the carriage having at least one wheel adapted for cooperation with the overhead track, the carriage also including, a support rod that extends down from the carriage, the support rod having an upper end that is attached to the wheel and a lower end that extends below the wheel, the lower end having a discontinuity that is adapted for insertion through the aperture in the bracket;

an engagement bar, the engagement bar being adapted for engaging the discontinuity at two locations along the engagement bar, so that the door may be suspended from the track through the carriage by inserting the discontinuity through the bracket and engaging the discontinuity with the engagement bar, trapping the lower end of the support rod through the aperture in the bracket.

It will be understood that the disclosed invention will allow the removal and re-installation of the door without having to tear away any of the molding or finish structure that surrounds the opening for the pocket door. According to one example of the invention a positioning bar of adjustable length is used to simultaneously retain the carriages at the appropriate locations and guide the support rods into the apertures in each of the brackets.

According to one example of the invention the bracket is simply shaped like a belt-loop, having an up-side down, generally U-shaped portion and a pair of horizontal legs extending from the U-shaped portion. The horizontal legs of the U-shaped portion are adapted for attaching the bracket to the upper edge of the door. The aperture that accepts the support rod from the carriage is designed to allow the discontinuity or portion of the support rod such that the engagement bar may be slid under the U-shaped portion until it engages the discontinuity, capturing the discontinuity below the U-shaped portion.

The engagement bar will include a pair of locations for engaging the discontinuity, allowing the engagement bar to be used to simultaneously capture a pair of discontinuities from a pair of support rods, with their associated carriages. This will allow the engagement bar to control the connection or disengagement of both carriages at one time. According to one example of the invention, the brackets have been adapted for mounting along the top of the upper edge of the door. Once mounted, the engagement bar will slide under both brackets. This allows the door to be supported by two carriages from the track.

Still further, it is contemplated that the engagement bar is spring loaded, so that the engagement bar is biased to keep the engagement bar against the discontinuity. This keeps the engagement bar in a locked position, with the discontinuity trapped by the engagement bar.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
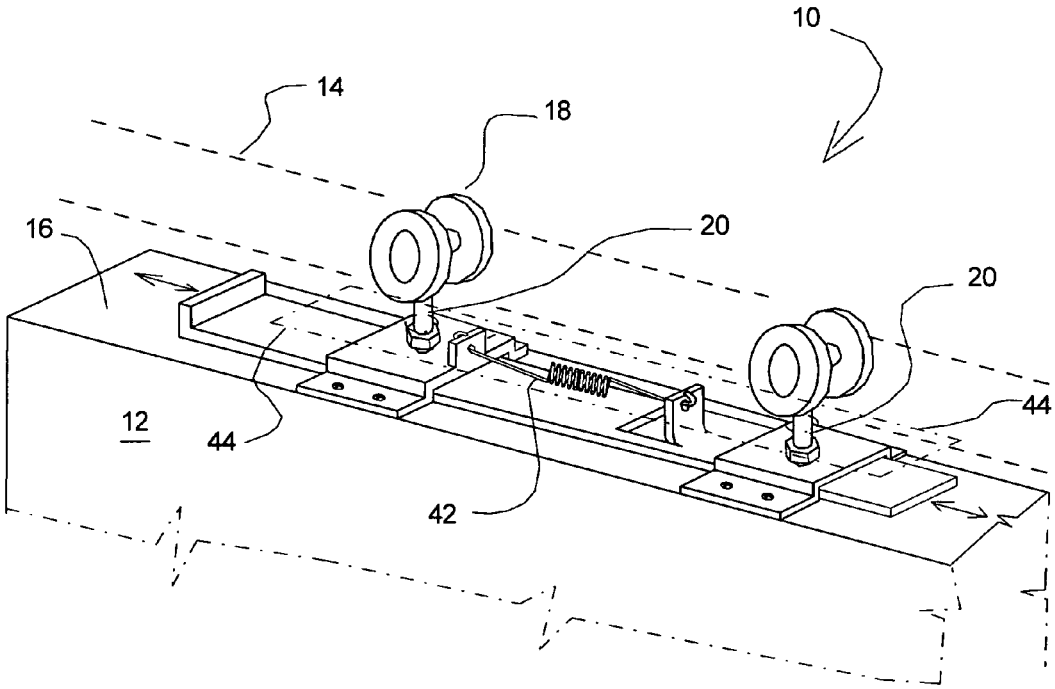
FIG. 1 is a perspective view of an embodiment of the invention while in use to support a pocket door.

Turning now to FIG. 1 where a support system 10 for mounting a door 12 on an overhead track 14, such as the track commonly found in a pocket door. A "pocket door" is a door that opened by sliding the door into an adjacent structure, such as a wall. Illustrated in FIG. 1 is that the door 12 will include an upper edge 16, from which the door 12 is attached to a carriage 18 that rides on the overhead track 14. Examples of carriages and tracks used with pocket doors can be found in U.S. Pat. Nos. 6,463,625 and 6,209,171, both of which are incorporated herein in their entirety by reference.

Also illustrated in FIG. 1 is that it is contemplated that the carriage 18 will include a support rod 20 that extends down from the carriage 18. The support rod 20 also includes a lower end 22 that includes a discontinuity 24. The discontinuity 24 has been illustrated as being generally mushroom-shaped, but it is contemplated that various other shapes may be used. For example, a notched out or grooved section may be used to define the discontinuity 24.

Figure 2:
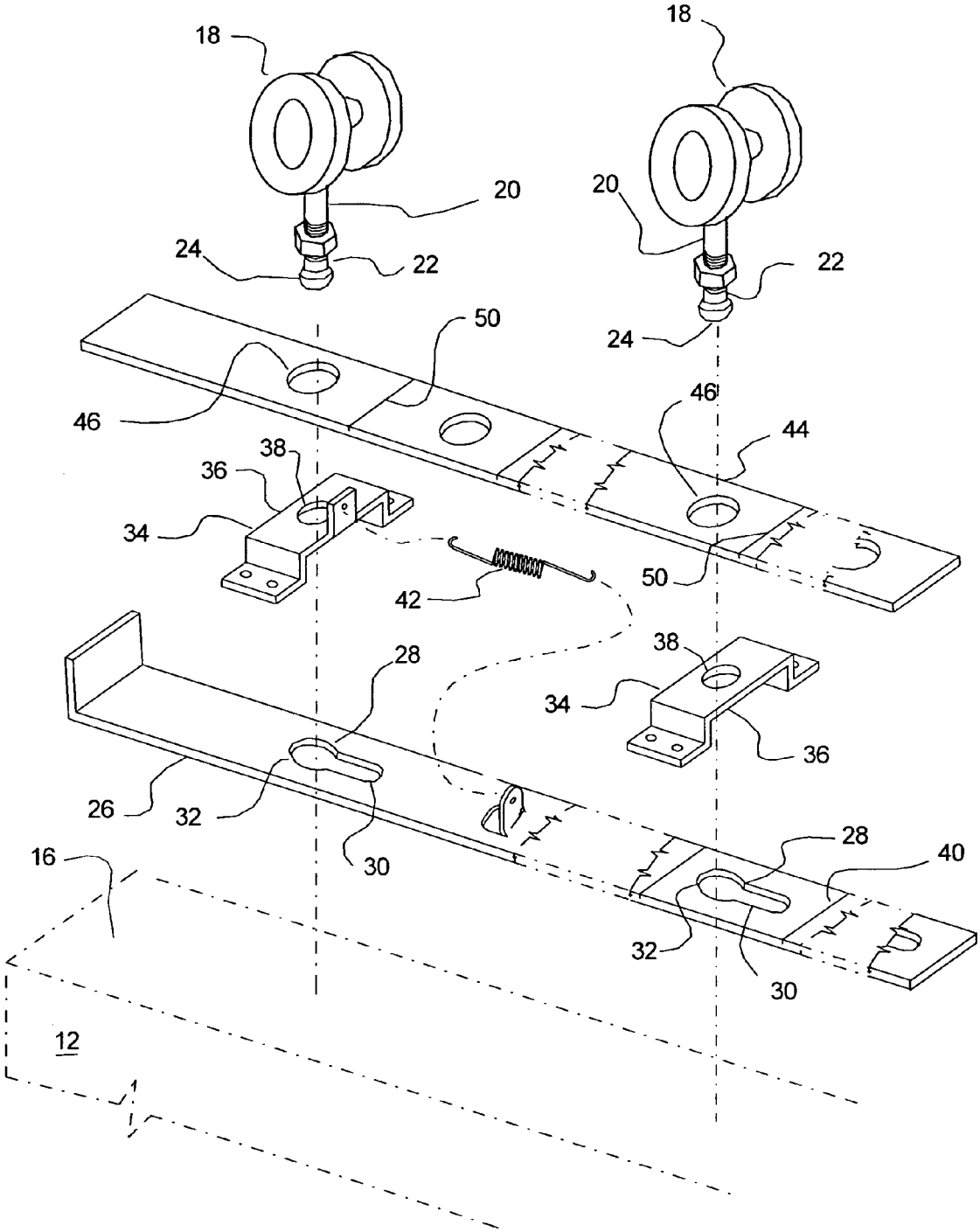
FIG. 2 is an exploded view illustrating examples of parts used with the system.
Figure 3:
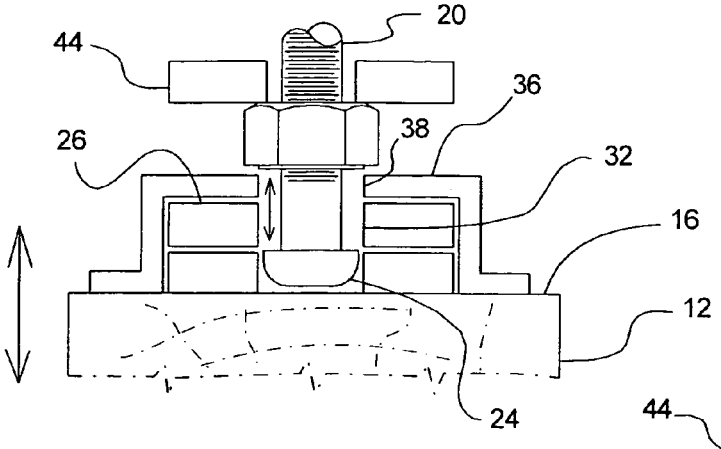
FIG. 3 is a section illustrating the use of a positioning bar and the engagement bar while in the release position, with the discontinuity free to move past the engagement bar, through an aperture that allows the discontinuity to be moved through the engagement bar.
Figure 4:
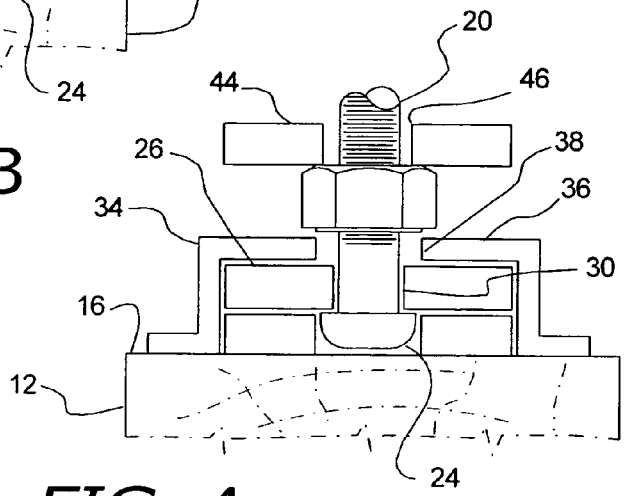
FIG. 4 is a section illustrating the use of a positioning bar and the engagement bar while in the locked position, with the discontinuity trapped by the engagement bar.

Turning to FIGS. 1–4, it will be understood that the discontinuity 24 will cooperate with an engagement bar 26 that has been adapted for engaging the discontinuity 24 on the support rod 20. As illustrated in FIGS. 2–4, the adaptation of the discontinuity that allows the engagement bar 26 to engage the discontinuity 24 is an aperture 28 that extends through the engagement bar 26. The aperture 28 in this preferred example includes a slotted section 30 that terminates in a rounded portion 32 that is of a diameter that permits the discontinuity to pass through the rounded portion 32, while the slotted section 30 prevents the discontinuity from passing through the engagement bar.

It is important to note that the shape of the aperture 28 depends on the type of discontinuity being used. Thus if the support rod 20 includes a discontinuity that extends from the support rod 20 at ninety degrees from the support rod 20, making the support rod 20 generally "L" shaped, then the aperture 28 need only be slotted or angled to allow the discontinuity 24 to pass through the engagement bar 26.

Also shown on FIGS. 2–4 is that it is contemplated that the support rod 20 will extend through a bracket 34 that is adapted for mounting along the upper edge of the door. As illustrated, it is contemplated that the bracket 34 will include a bridging section 36 that includes an aperture 38 therethrough. The aperture 38 has been sized to allow the support rod 20 to extend through the bridging section 36, so that the lower end 22 of the support rod 20 may be inserted into the aperture 28 in the engagement bar 26. Thus, to attach the door to the support rod 20, one would simply position the rounded portion 32 of the aperture 28 in the engagement bar 26 immediately below the aperture 38 through the bridging section 36. Then the discontinuity 24 in the support rod 20 would be inserted trough the aperture 38 in the bridging section 36 and through the aperture 28 in the engagement bar 26. This first position, where the engagement bar 26 allows movement of the discontinuity 24 through the engagement bar 26 is illustrated in FIG. 3.

Once the discontinuity 24 extends through the rounded portion 32 of the aperture 28 in engagement bar 26, the engagement bar 26 is moved to allow the slotted section 30 of the aperture 28 to engage the support rod 20, and thus capturing the discontinuity 24 below the engagement bar 26. This second position is illustrated in FIG. 4. Once the support rod 20 is captured by the engagement bar 26, the system 10 will allow the door to be suspended from the track 14 through the carriage 18.

As illustrated in FIG. 2, it is contemplated that at least two apertures 28 adapted for receiving the discontinuity 24 will be incorporated into the engagement bar 26. Additionally, in order to fabricate a single engagement bar 26 that can be easily modified by the installer in the field, it is contemplated that each engagement bar 26 will include a plurality of apertures 28. Weakened sections 40 will be placed between the apertures 28. These weakened sections 40 will allow easy separation or division of the engagement bar 26 to modify the overall length of the engagement bar, so that the engagement bar 26 fits along the upper edge 16 of the door 12 and provides additional engagement points for additional support rods 20 and associated carriages.

Also illustrated in FIGS. 1 and 2 is that it is contemplated that a spring 42 will be mounted between one of the brackets 34 and the engagement bar 26, such that the spring 42 biases the engagement bar 26 to the second position, illustrated in FIG. 4, where the engagement bar 26 engages or captures the support rod 10 below the engagement bar 26. The spring is attached to the engagement bar 26 and at least one of the brackets 34. It is important to note that while a tension spring is included in the illustrated example, it is also contemplated that a compression spring may also be used to bias the engagement bar 26 to the second position.

Turning to FIGS. 2, 3 and 4 it will be understood that it is also contemplated that a positioning bar 44 may also be used with the disclosed invention. The positioning bar 44 is placed on the support rods 20 and provide recesses 46 that position the location the carriages 18 and their respective support rods and discontinuity 24, so that it can be easily inserted into the recesses 46 of the engagement bar 26, allowing the engagement bar to be moved to the second position, illustrated in FIG. 4, from the first position, illustrated in FIG. 3.

Figure 5:
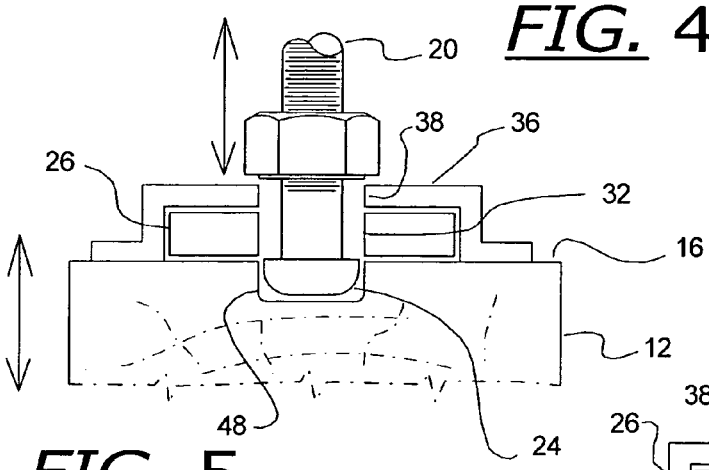
FIG. 5 is a section illustrating the engagement bar while in the release position, with the discontinuity free to move past the engagement bar, through an aperture that allows the discontinuity to be moved through the engagement bar.
Figure 6:
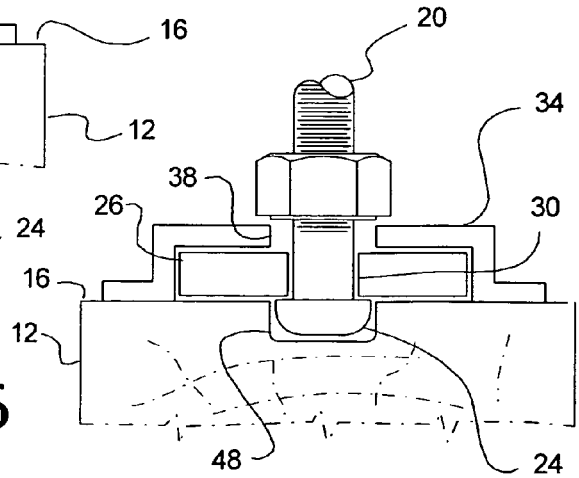
FIG. 6 is a section illustrating the engagement bar while in the locked position, with the discontinuity trapped by the engagement bar.

The example illustrated in FIGS. 3 and 4, show use the positioning bar 44, but FIGS. 5 and 6 illustrate the use of a hole 48 drilled into the upper edge 16 of the door 12 to provide space needed for the protrusion needed to extend below the engagement bar 26.

FIG. 2 illustrates that it is contemplated that the positioning bar 44 will also include weakened areas 50 to allow separation of portions of the positioning bar 44 in order to easily adjust the length of the positioning bars. In the illustrated examples, scoring the surface of the material forms the weakened areas.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A support system for mounting a door on an overhead track, the door having an upper edge, the door being attached through the upper edge to a carriage that rides on the overhead track, the carriage including a support rod that extends down from the carriage to a lower end, the support rod having a discontinuity at the lower end, the system comprising:

a bracket that is adapted for mounting along the upper edge of the door, the bracket including a bridging portion that includes an aperture therethrough, the aperture being adapted for accepting the support rod therethrough;

an engagement bar, the engagement bar being adapted for engaging the discontinuity on the support rod at least one location along the engagement bar; and a spring that is mounted between the bracket and the engagement bar such that the spring biases the engagement bar to a position where the engagement bar engages the support rod, so that the door is suspended from the track through the carriage by inserting the discontinuity through the bracket and engaging the discontinuity with the engagement bar, trapping the lower end of the support rod through the aperture in the bracket.

2. A support system according to claim 1 wherein said at least one location for adapted for engaging the discontinuity comprises two apertures, each aperture being adapted for receiving the discontinuity.

3. A support system according to claim 2 wherein each of said at least two apertures comprises a narrow section and an enlarged aperture, the enlarged aperture being adapted for accepting the discontinuity therein.

4. A support system according to claim 1 wherein said engagement bar is of a length, and the engagement bar further comprises weakened sections that allow the separation of the engagement bar along the length of the engagement bar.

5. A support system for mounting a door on an overhead track, the door having an upper edge, the door being attached through the upper edge to at least carriages that ride on the overhead track, each of the carriages including at least one support rod that includes a lower end that extends down from the carriage, the support rod of each carriage having a discontinuity at the lower end, the system comprising:

a pair of brackets, each bracket being adapted for mounting along the upper edge of the door, each of the brackets including a bridging portion that includes an aperture therethrough, the aperture through the bracket being adapted for allowing the support rod to extend theretrough;

an engagement bar, the engagement bar being adapted for sliding between the brackets and having at least two slotted openings along the engagement bar, each of the slotted openings being adapted for engaging the discontinuity, so that the door is suspended from the track through the carriage by inserting the discontinuity through the bracket and engaging the discontinuity with the engagement bar, trapping the lower end of the support rod through the aperture in the bracket.

6. A support system according to claim 5 wherein said at least two slotted openings have been adapted for preventing the discontinuity from being easily passed through the slotted openings.

7. A support system according to claim 6 wherein at least one of the brackets comprises a spring, the spring being mounted between the bracket and the engagement bar such that the spring biases the engagement bar to a position where the slotted openings of the engagement bar engage each of the support rods.

8. A support system according to claim 5 wherein said engagement bar is of a length, and the engagement bar further comprises weakened sections that allow the separation of the engagement bar along the length of the engagement bar.

9. A method for mounting a door on an overhead track to allow the door to move along the track, the door having an upper edge, the door being attached through the upper edge to at least one carriage that rides on the overhead track, each carriage including at least one support rod that included a lower end that extends down from the carriage, the support rod having a discontinuity at the lower end, the method comprising:

providing a bracket that is adapted for mounting along the upper edge of the door, the bracket including a bridging portion that includes an aperture therethrough, the aperture being adapted for accepting the support rod therethrough;

providing an engagement bar, the engagement bar being adapted for engaging the discontinuity on the support rod at least one location along the engagement bar;

suspending the door from the track through the carriage by inserting the discontinuity through the bracket and simultaneously engaging the discontinuity of each support rod with the engagement bar, and then trapping the lower end of the support rod through the aperture in the bracket.

10. A method according to claim 9 and further comprising attaching a spring between the engagement bar and the bracket, so that the spring biases the engagement bar so that the single engagement bar simultaneously engages the discontinuities on each support rod.

11. A method according to claim 9 and further comprising providing weakened areas along the engagement bar and a plurality of apertures along the engagement bar for engaging the discontinuities on the support rod, so that the engagement bar may be trimmed by breaking the engagement bar along the weakened areas.

12. A method according to claim 9 and further comprising sliding the engagement bar between the bracket and the upper edge of the door, so that the engagement bar engages the support rod from below the bracket.

* * * * *